US007004683B1

(12) United States Patent
Rupiper

(10) Patent No.: US 7,004,683 B1
(45) Date of Patent: Feb. 28, 2006

(54) HELICE PIERHEAD MOUNTING PLATE AND BOLT ASSEMBLY

(76) Inventor: Stan Rupiper, P.O. Box 465, Tahoma, CA (US) 96142

( * ) Notice: Subject to any disclaimer, the term of this patent is extended or adjusted under 35 U.S.C. 154(b) by 0 days.

(21) Appl. No.: 11/087,960

(22) Filed: Mar. 22, 2005

Related U.S. Application Data

(60) Provisional application No. 60/556,710, filed on Mar. 26, 2004.

(51) Int. Cl.
*E02D 5/00* (2006.01)

(52) U.S. Cl. ..... 405/229; 405/230; 405/231; 405/252.1; 52/165; 52/157

(58) Field of Classification Search ..... 405/229–232, 405/252.1, 253, 255; 52/155, 157, 165
See application file for complete search history.

(56) References Cited

U.S. PATENT DOCUMENTS 5,066,168 A * 11/1991 Holdeman ..... 405/249
6,503,024 B1 * 1/2003 Rupiper ..... 405/230
6,539,685 B1 * 4/2003 Bell et al. ..... 405/229
6,722,821 B1 * 4/2004 Perko et al. ..... 405/249

* cited by examiner

*Primary Examiner*—Frederick L. Lagman
(74) *Attorney, Agent, or Firm*—Edwin H. Crabtree; Ramon L. Pizarro; Donald W. Margolis

(57) ABSTRACT

A mounting plate and bolt assembly adapted for attachment to a top portion of a helice pier shaft. The helice pier shaft threaded into the top of a ground surface. The assembly is used for supporting various types of building, highway and other types of structures. The mounting plate and bolt assembly includes small circular upper and lower pierhead plates spaced apart and welded to the top portion of the helice pier shaft. Also, large circular upper and lower mounting plates with bolt holes are disposed next to the upper and lower small pierhead plates and held thereon using a plurality of threaded bolts received through the bolt holes. The bolt holes are disposed around an outer circumference of the large mounting plates. The top of the threaded bolts may be used for securing a base plate of a post. The post is used for supporting various types of structures thereon. The large mounting plates may be welded directly to the pier shaft if the movement of the post is not large.

15 Claims, 2 Drawing Sheets

FIG. 3
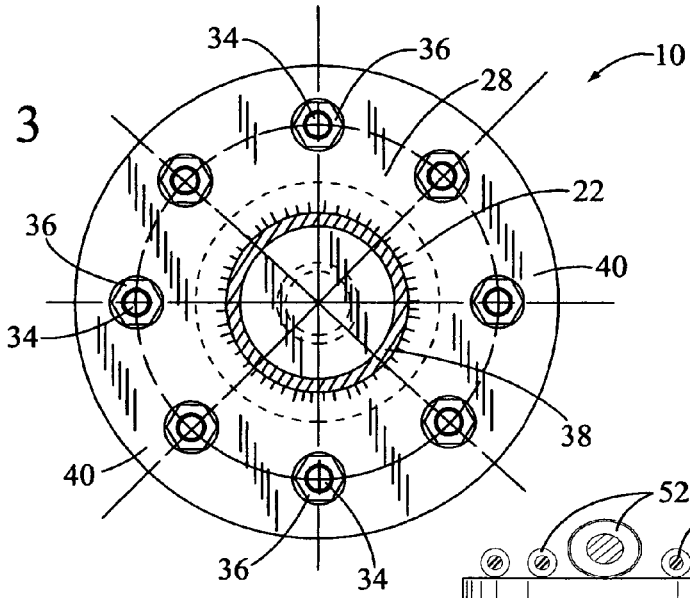
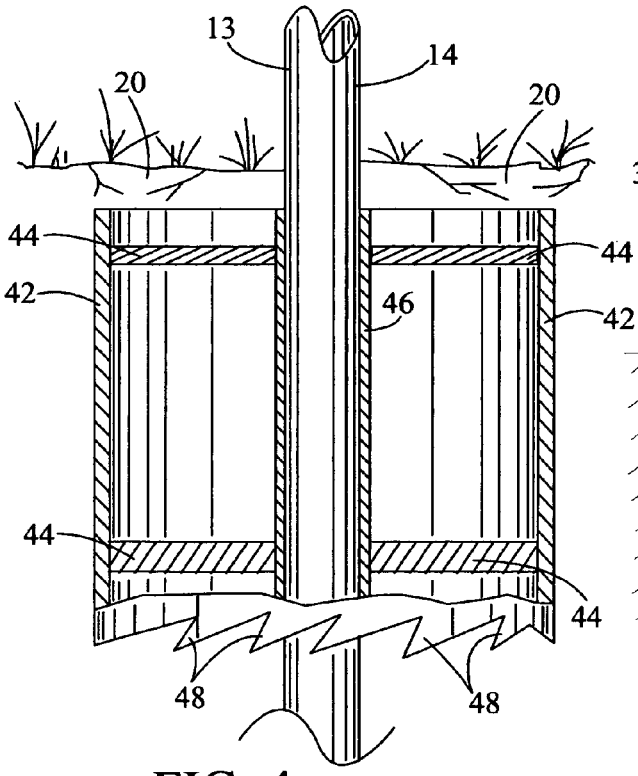
FIG. 4
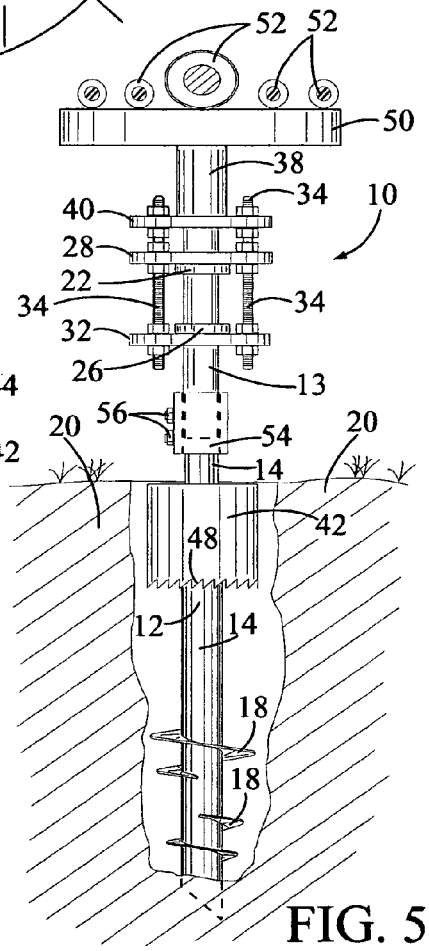
FIG. 5

HELICE PIERHEAD MOUNTING PLATE AND BOLT ASSEMBLY

This application claims benefits of and is based on an earlier filed provisional patent application filed on Mar. 26, 2004, Ser. No. 60/556,710, by the subject inventor.

BACKGROUND OF THE INVENTION (a) Field of the Invention

This invention relates to a mounting plate and bolt assembly used for supporting various types of structures above a ground surface and more particularly, but not by way of limitation, to a helice pierhead mounting plate and bolt assembly attached to a top portion of a helice pier shaft. The mounting plate and bolt assembly are used for supporting various building structures thereon.

(b) Discussion of Prior Art

Heretofore, structures and foundations have been built with deep excavations, which disturb the environment. Also, shallow foundations in many cases have differential settlement and are subject to undesirable movement due to seismic and other types of ground and soil movement.

In the past, there have been a variety of ground anchor devices used for soil stabilization. In particular, U.S. Pat. No. 6,058,662 to Howard A. Perko and U.S. Pat. Nos. 5,904,447, 5,919,005 and 5,934,836 to Stanley J. Rupiper et al. disclose recent anchor devices using helical piers for stabilizing soil, securing building foundations and other structures. Also, the patents cited during the prosecution of the above patents are incorporated herein by reference.

Today, a number of United States companies manufacture foundation anchors having a hollow pipe shaft with a fixture mounting plate attached to the top of the pipe shaft. A helix is attached around a circumference of a lower portion of the pipe shaft. The helix is used for rotating the foundation anchor into a ground surface. The foundation anchors can be used for securing light poles, telephone poles, road signs, walls, walkways, building column supports and the like thereon.

None of the prior art ground anchor devices and foundation supports described in the cited patent references provide the unique features, structure, and advantages of the subject helice pierhead mounting plate and bolt assembly and method of grouting around a helice pier as described herein.

SUMMARY OF THE INVENTION

In view of the foregoing, it is a primary objective of the subject invention to provide a helice pier with pier shaft that can be rotated into a ground surface with the top of the pier shaft, called a pier head, having a mounting plate used for securing various types of building structures, foundations, columns, fence posts, light posts, sound barriers, signage and like items.

Another object of the invention is to provide a plurality of helice piers with the subject invention mounted on a top thereof to provide a new building concept for more stable building foundations when compared to similar types of installations.

Yet another object of the invention is the assembly allows for more rapid, stable and uniform construction of structures on all types of terrain and soil conditions. Also, the helice piers used with the subject invention can be grouted around the piers for greater resistance to vertical, forced, lateral forces and resistance to corrosion.

Still another object of the invention is, by the nature of it's construction, the plate and bolt assembly can be used in unstable ground conditions and used for providing lateral support for foundations, buildings and other structures.

The mounting plate and bolt assembly includes small circular upper and lower pierhead plates spaced apart and attached to a top portion of a helice pier shaft. Also, large circular upper and lower mounting plates with bolt holes are disposed next to the upper and lower small pierhead plates and held thereon using a plurality of threaded bolts received through the bolt holes. The bolt holes are disposed around a circumference of the large mounting plates. The top of the threaded bolts may be used for securing a base plate of a post used with various types of structures. The large mounting plates may be welded directly to the pier shaft if the movement of the post is not large.

These and other objects of the present invention will become apparent to those familiar with ground and soil stabilization devices and helical piers used in stabilizing soil, building foundations, concrete slabs and other structures when reviewing the following detailed description, showing novel construction, combination, and elements as herein described, and more particularly defined by the claims, it being understood that changes in the embodiments to the herein disclosed invention are meant to be included as coming within the scope of the claims, except insofar as they may be precluded by the prior art.

BRIEF DESCRIPTION OF THE DRAWINGS

The accompanying drawings illustrate complete preferred embodiments in the present invention according to the best modes presently devised for the practical application of the principles thereof, and in which:

FIG. 3 is a top view of the mounting plate and bolt assembly taken along lines 3—3 shown in FIG. 1.

FIG. 4 is a cross sectional view of a pressure barrel placed over a lower pier shaft and attached to a portion of the helice pier shaft. A lower portion of the barrel is shown with serrated teeth used for threading the helice pier shaft into the top of a ground surface. The barrel is optional and need not be used where consistency of soil is adequate or the pierhead can be filled with grout and the like.

FIG. 5 is a front view of the assembly attached to a bottom of a post. The top of the post is shown holding a plurality of utility lines above a ground surface. The pressure barrel is shown disposed over the top of the pier shaft and next to the top of the ground surface.

While the invention has been particularly shown, described and illustrated in detail with reference to the preferred embodiments and modifications, it should be understood by those skilled in the art that equivalent changes in form and detail may be made without departing from the true spirit and scope of the invention as claimed except as precluded by the prior art.

DETAILED DESCRIPTION OF THE PREFERRED EMBODIMENTS

Figure 1:
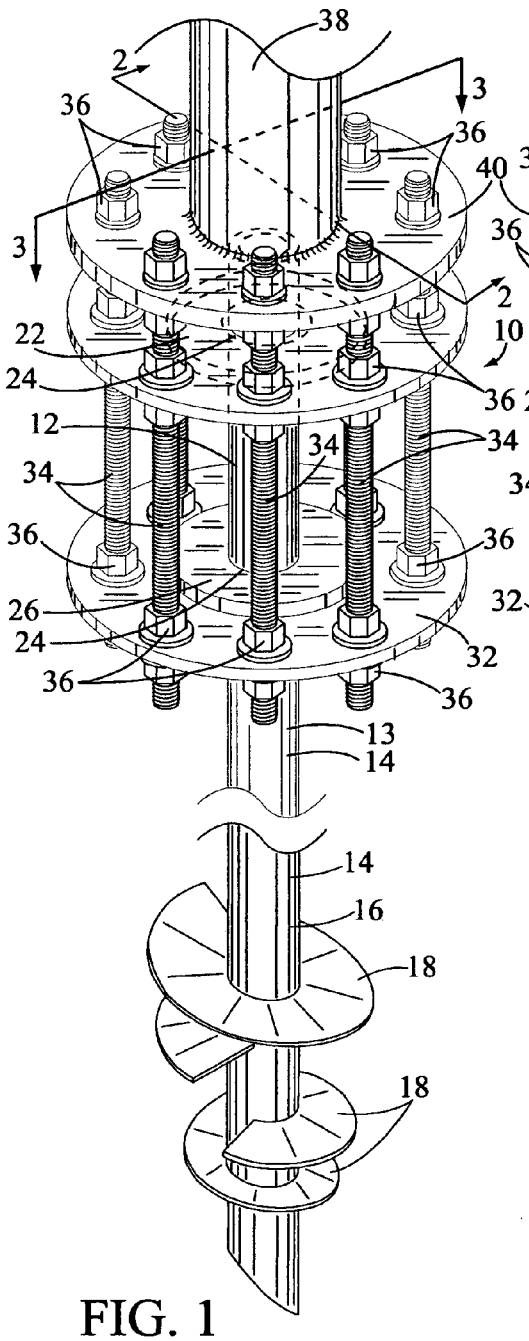
FIG. 1 is a perspective view the mounting plate and bolt assembly attached to a top portion of a helice pier shaft. A lower portion of a post with post base plate are shown with the base plate attached to the threaded bolts of the assembly.

In FIG. 1, a perspective view of the mounting plate and bolt assembly is shown having general reference numeral 10. The assembly 10 is shown received around a top portion 12 of a helice pier 13 with helice pier shaft 14. The top portion 12 is often referred to as a "pier head". A bottom portion 16 of the pier shaft 14 includes a plurality of helice 18 for screwing the pier shaft 14 into a ground surface 20. The ground surface 20 is shown in FIGS. 4 and 5. Also, the pier shaft 14 can be coupled to the top of a second pier shaft 14 with helice thereon and when added depth of the installation is required and depending on ground conditions.

The assembly 10 includes a small circular upper pierhead plate 22 with shaft hole 24 therein for receipt around the top portion of the pier shaft 14. A similar small circular lower pierhead plate 26 with shaft hole 24 therein is also received around the top portion of the pier shaft 14. The two pierhead plates 22 and 26 are spaced apart and welded to the pier shaft 14.

A large circular upper mounting plate 28 with bolt holes 30 disposed around it's outer circumference and a shaft hole 24 is received around the top portion of the pier shaft 14 and disposed on top of and next to the upper pierhead plate 22. A similar large circular lower mounting plate 32 with bolt holes 30 disposed around it's outer circumference and shaft hole 24 is received around the pier shaft 14 and disposed under and next to the lower pierhead plate 26. The bolt holes 30 are used to receive a portion of all thread bolts 34 therethrough. Nuts 36 are threaded on the bolts 34 for securing and compressing the upper mounting plate 28 against the top of the upper pierhead plate 22 and securing and compressing the lower mounting plate 32 against the bottom of the lower pierhead plate 26. Also depending on the loads on the assembly 10 and the helice pier 13, the large upper and lower mounting plates 28 and 32 can be welded to the pier shaft 14.

In this drawing, a lower portion of a post 38 is shown with a post mounting plate 40 having bolt holes 30 therein. The bolt holes 30 are indexed above the bolt holes 30 in the upper mounting plate 22. An upper portion of the all thread bolts 34 are received through the bolt holes 30 in the post mounting plate 40. Using the nuts 36, the vertical height of the post 38 can be adjusted with the nuts 36 and the bolts 34 securing the post 38 above the mounting plate and bolt assembly 10.

Figure 2:
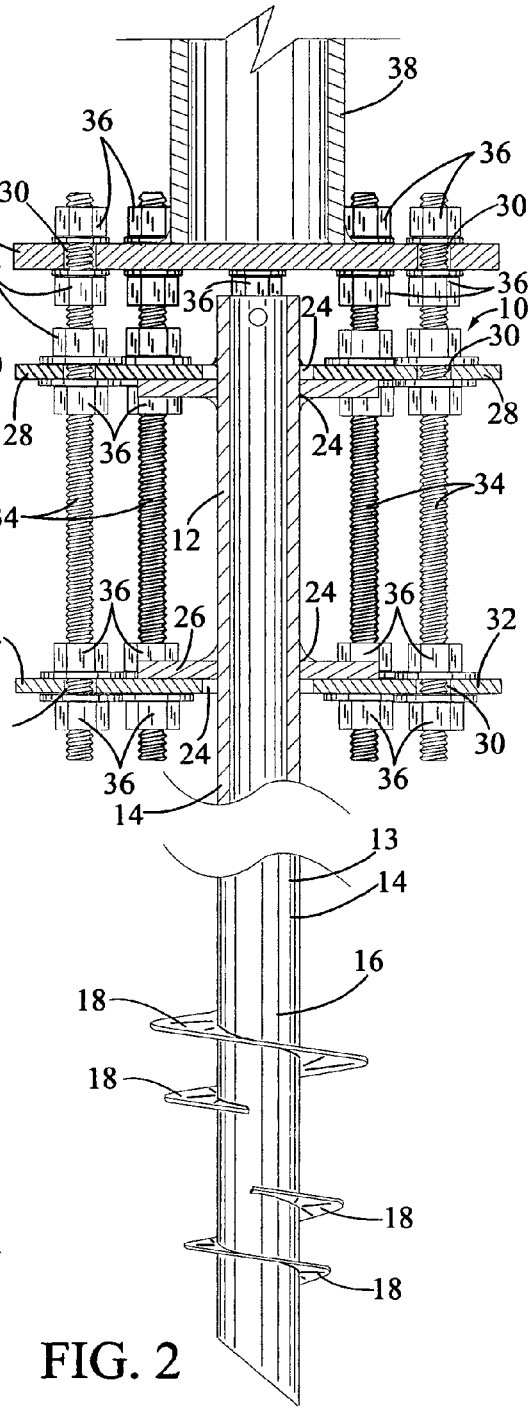
FIG. 2 is a cross sectional view of the mounting plate and bolt assembly taken along lines 2—2 shown in FIG. 1.

In FIG. 2, a cross sectional view of the mounting plate and bolt assembly 10 is shown taken along lines 2—2 shown in FIG. 1. In this drawing, the post 38 and post mounting plate 40 can be seen disposed above the top of the pier shaft 143 with the plate 40 secured to the all thread bolts 34.

In FIG. 3, a top view of the mounting plate and bolt assembly 10 is shown taken along lines 3—3 shown in FIG. 1. In this view, the all thread bolts 34 are shown disposed around the outer circumference of the post mounting plate 40. Obviously, any number of bolts 34 and nuts 36 can be used with the assembly 10 depending on the load conditions placed on the helice pier 13 and the mounting plate and bolt assembly 10.

In FIG. 4, a cross sectional view of a pressure barrel 42 is shown having cross members 44 attached to the inside of the barrel 42 and to a barrel sleeve 46. The barrel sleeve 46 is adapted for receipt around a portion of the pier shaft 14 and welded or placed in a press fit thereon. The bottom of the pressure barrel 42 includes serrated teeth 48 used for threading or cutting the helice pier shaft 14 with attached barrel 42 into the top of a ground surface 20.

In FIG. 5, a front view of the assembly 10 is shown attached to a bottom of the post 38. The top of the post 28 is attached to a horizontal utility line support beam 50. The support beam 50 is shown holding a plurality of utility lines 52 above the ground surface 20. While the utility line support beam 50 is shown with post 28 mounted on the mounting plate and bolt assembly 10, it should be kept in mind any number of different types of support structures, signage, walkway, light and fence posts, sound barriers, columns and foundations can be secured by using the assembly 10 with the helice pier 13. Also, the pier shaft 14 can be coupled together using a splice collar 54 with nuts 56 with one or more pier shafts 14 for threading and cutting into different types of ground surfaces and at different depths. Further, the top portion 12 of the pier shaft 14 can be adjusted at various heights above the ground surface 20 as shown in FIG. 5.

In this drawing, a portion of the ground surface 20 has been cutaway to illustrate the pressure barrel 42 attached to the pier shaft 14 and disposed next to the top of the ground surface 20. For added stability, the area around the pressure barrel 42 and the top portion 12 of the pier shaft 14 can be grouted for added strength for various types of lateral and vertical load conditions depending on the soil type and supporting structures placed thereon.

While the invention has been particularly shown, described and illustrated in detail with reference to the preferred embodiments and modifications thereof, it should be understood by those skilled in the art that equivalent changes in form, function and detail may be made without departing from the spirit and scope of the invention as claimed except as precluded by the prior art.

The embodiments of the invention for which exclusive privilege and property right is claimed are defined as follows:

1. A mounting plate and bolt assembly adapted for mounting on a pier shaft of a helice pier, the helice pier threaded into a ground surface, the assembly used for securing a post mounting plate with bolt holes therein and a post extending upwardly therefrom, the post used for holding different types of structures thereon, the assembly comprising:a an upper pierhead plate adapted for receipt around a portion of the pier shaft and attached thereto;

a lower pierhead plate adapted for receipt around a portion of the pier shaft and attached thereto, said upper pierhead plate disposed above and spaced apart from said lower pierhead plate;

a large upper mounting plate adapted for receipt around a portion of the pier shaft, said upper mounting plate having a plurality of bolt holes spaced therein, said upper mounting plate disposed on a top of said upper pierhead plate;

a large lower mounting plate adapted for receipt around a portion of the pier shaft, said lower mounting plate having a plurality of bolt holes therein, said lower mounting plate disposed against a bottom of said lower pierhead plate;

a plurality of bolts received through the bolt holes in said upper and lower mounting plates, said bolts receiving nuts thereon for securing said upper and lower mounting plates on said upper and lower pierhead plates; and an upper portion of said bolts adapted for receipt through the bolt holes in the post mounting plate, the upper portion of said bolts receiving nuts thereon for securing the post on top of the assembly.

2. The assembly as described in claim 1 wherein said upper pierhead plate is a small circular upper pierhead plate with shaft hole therein, the shaft hole adapted for receipt around a portion of the pier shaft and attached thereto and said lower pierhead plate is a small circular lower pierhead plate with shaft hole therein, the shaft hole adapted for receipt around a portion of the pier shaft and attached thereto.

3. The assembly as described in claim 1 wherein said upper mounting plate is a large circular upper mounting plate with shaft hole therein, the shaft hole adapted for receipt around a portion of the pier shaft, said upper mounting plate having a plurality of bolt holes spaced around an outer circumference thereof and said lower mounting plate is a large circular lower mounting plate with shaft hole therein, the shaft hole adapted for receipt around a portion of the pier shaft, said lower mounting plate having a plurality of bolt holes spaced around an outer circumference thereof.

4. The assembly as described in claim 1 wherein said bolts are all thread bolts extending through the bolt holes in said upper and lower mounting plates and the bolt holes in the post mounting plate.

5. The assembly as described in claim 1 wherein said upper and lower pierhead plates are welded to a portion of the pier shaft.

6. The assembly as described in claim 1 wherein said upper and lower mounting plates are welded to a portion of the pier shaft.

7. A mounting plate and bolt assembly adapted for mounting on a pier shaft of a helice pier, the helice pier threaded into a ground surface, the assembly used for securing a post mounting plate with bolt holes therein and a post extending upwardly therefrom for holding different types of structures thereon, the assembly comprising:a a small circular upper pierhead plate with shaft hole therein, the shaft hole adapted for receipt around a portion of the pier shaft and attached thereto;

a small circular lower pierhead plate with shaft hole therein, the shaft hole adapted for receipt around a portion of the pier shaft and attached thereto, said upper pierhead plate disposed above and spaced apart from said lower pierhead plate;

a large circular upper mounting plate with shaft hole therein, the shaft hole adapted for receipt around a portion of the pier shaft, said upper mounting plate having a plurality of bolt holes spaced around an outer circumference thereof, said upper mounting plate disposed on a top of said upper pierhead plate;

a large circular lower mounting plate with shaft hole therein, the shaft hole adapted for receipt around a portion of the pier shaft, said lower mounting plate having a plurality of bolt holes spaced around an outer circumference thereof, said lower mounting plate disposed on a bottom of said lower pierhead plate;

a plurality of bolts received through the bolt holes in said upper and lower mounting plates and nuts for securing said upper and lower mounting plates on said upper and lower pierhead plates; and an upper portion of said bolts adapted for receipt through the bolt holes in the post mounting plate and with nuts securing the post on top of the assembly.

8. The assembly as described in claim 7 wherein said bolts are all thread bolts extending through the bolt holes in said upper and lower mounting plates, an upper portion of the all thread bolts received through the bolt holes in the post mounting plate.

9. The assembly as described in claim 7 wherein said upper and lower pierhead plates are welded to an upper portion of the pier shaft.

10. The assembly as described in claim 7 wherein said upper and lower mounting plates are welded to a upper portion of the pier shaft.

11. A mounting plate and bolt assembly for securing a post mounting plate with bolt holes therein and a post extending upwardly from the post mounting plate, the assembly comprising:

a helice pier with a pier shaft, the helice pier adapted for threading into a ground surface;

a small circular upper pierhead plate with shaft hole therein, the shaft hole adapted for receipt around a portion of said pier shaft and attached thereto;

a small circular lower pierhead plate with shaft hole therein, the shaft hole adapted for receipt around a portion of said pier shaft and attached thereto, said upper pierhead plate disposed above and spaced apart from said lower pierhead plate;

a large circular upper mounting plate with shaft hole therein, the shaft hole adapted for receipt around a portion of said pier shaft, said upper mounting plate having a plurality of bolt holes spaced around an outer circumference thereof, said upper mounting plate disposed on a top of said upper pierhead plate;

a large circular lower mounting plate with shaft hole therein, the shaft hole adapted for receipt around a portion of said pier shaft, said lower mounting plate having a plurality of bolt holes spaced around an outer circumference thereof, said lower mounting plate disposed on a bottom of said lower pierhead plate;

a plurality of bolts received through the bolt holes in said upper and lower mounting plates and nuts for securing said upper and lower mounting plates on said upper and lower pierhead plates; and an upper portion of said bolts adapted for receipt through the bolt holes in the post mounting plate and with nuts securing the post on top of the assembly.

12. The assembly as described in claim 11 further including a pressure barrel attached to a portion of said pier shaft, said pressure barrel having serrated teeth thereon for helping thread said helice pier into the ground surface.

13. The assembly as described in claim 11 wherein said bolts are all thread bolts extending through the bolt holes in said upper and lower mounting plates, an upper portion of the all thread bolts received through the bolt holes in the post mounting plate.

14. The assembly as described in claim 11 wherein said upper and lower pierhead plates are welded to an upper portion of the pier shaft.

15. The assembly as described in claim 11 wherein said upper and lower mounting plates are welded to a upper portion of the pier shaft.

* * * * *